United States Patent [19]

Maki

[11] Patent Number: 4,506,605

[45] Date of Patent: Mar. 26, 1985

[54] SHOTGUN CARTRIDGE AND WAD THEREOF

[76] Inventor: Nagatoshi Maki, 2-48-4, Kamiishihara, Chofu-shi, Tokyo, Japan

[21] Appl. No.: 529,007

[22] Filed: Sep. 2, 1983

Related U.S. Application Data

[63] Continuation of Ser. No. 214,222, Dec. 8, 1980, abandoned.

[30] Foreign Application Priority Data

Apr. 15, 1980 [JP] Japan ..... 55-048734

[51] Int. Cl.[3] ..... F42B 7/02

[52] U.S. Cl. ..... 102/457; 102/453; 102/532; 244/3.23

[58] Field of Search ..... 102/448–463, 102/532; 244/3.23

[56] References Cited

U.S. PATENT DOCUMENTS

| | | |
|---|---|---|
| 777,031 | 12/1904 | La Dow . |
| 1,096,272 | 5/1914 | Sherman . |
| 2,924,174 | 2/1960 | McLean . |
| 3,058,423 | 10/1962 | Laager . |
| 3,074,344 | 1/1963 | Devaux . |
| 3,247,795 | 4/1966 | Abela . |
| 3,398,682 | 3/1968 | Abela . |
| 3,420,178 | 1/1969 | Rempel . |
| 3,452,677 | 7/1969 | Abela . |
| 3,507,220 | 4/1970 | McClure . |
| 3,750,579 | 8/1973 | Bellington . |
| 4,296,893 | 10/1981 | Ballmann . |

FOREIGN PATENT DOCUMENTS

| | | |
|---|---|---|
| 866822 | 11/1978 | Belgium . |
| 1454361 | 9/1966 | France . |
| 2199861 | 4/1974 | France . |
| 2218546 | 9/1974 | France . |
| 2292948 | 6/1976 | France . |
| 2372411 | 6/1978 | France . |
| 606149 | 7/1983 | Italy . |
| 172710 | 12/1921 | United Kingdom . |
| 18097 | of 1905 | United Kingdom . |

*Primary Examiner*—Harold J. Tudor

*Attorney, Agent, or Firm*—Merchant, Gould, Smith, Edell, Welter & Schmidt

[57] ABSTRACT

A wad located in a case of a shotgun cartridge containing gunpowder, comprising a cylindrical body which comprises a plurality of explosive gas passages to rotate the wad about the axis of the cylindrical body by the explosive gas which is produced by the explosion of the gunpowder.

19 Claims, 15 Drawing Figures

SHOTGUN CARTRIDGE AND WAD THEREOF

This is a continuation of application Ser. No. 214,222, filed Dec. 8, 1980, now abandoned.

This invention relates to a shotgun cartridge or ammunition for use with a choked barrel shotgun, and in particular to a shotgun cartridge which has a high hit probability even when it is adapted to shoot at a short distance with a shotgun for long distance shooting and which presents a higher hit probability at a near distance than that of a standard shotgun load when it is used with a short distance shooting shotgun. The invention is also directed to a wad located in a shotgun cartridge.

The shotgun is usually adapted to break up a target or to shoot game by causing a part of the spread shot to hit the target or the game which is moving. Therefore, no extremely accurate aiming is required to hit the target or game with a shotgun. Accordingly, one of the most important characteristics of a shotgun or shotgun load is how the fired shot is spread in accordance with the shooting range.

The degree of spread of a shot is usually represented by a "pattern" which will be referred to hereinafter and which is defined by the mark of pellets on a plane perpendicular to and located at the extension of a barrel axis. Furthermore, "an effective area of the pattern" used herein is defined by a circular area of the pattern density in which it is deemed that a clay target can be cracked or game can be hit with a certainty of 80% at a desired shooting range. A pellet designates herein a lead alloy ball which hits the target or game, and a shot herein designates a mass of pellets.

Some shotguns have barrels each of which is manufactured in such a manner that a portion adjacent the top end of the muzzle thereof is choked to reduce the effective area of the pattern and to increase the pattern density so as to enable the shotguns to become fitted for long distance shooting. The barrel of such structure and the reduced portion will hereinafter be referred to as a "choked barrel" and a "choke", respectively. A (40″/1000) reduction at the diameter is called a "full choke", and no reduction barrel is called a "true cylinder". Further, $\frac{3}{4}$ choke, $\frac{1}{2}$ choke, and $\frac{1}{4}$ choke are provided between the full choke and the true cylinder. In particular, a barrel having a slight reduction of approximately (3″/1000) is called an improved cylinder.

It should be noted that when two shots containing the same number of pellets are fired into a target at the same shooting range by shotguns which have different choked barrels, the pattern density and the effective area of the pattern of the shotgun having a largely choked barrel are higher and smaller than those of the other shotgun which has a small choked barrel, respectively. Therefore, when a short distance shooting is effected by a shotgun having a full choked barrel or $\frac{3}{4}$ choked barrel which is principally useful for long distance shooting, the shot tends to fail to hit the game. Further, even when the shot hits the game, excessive pellets are concentrated on the game, which causes extensive damage on the game, thereby reducing its value.

In order to solve this problem, there is proposed a double-barrelled shotgun which has differently choked barrels, or a single barrelled shotgun which has a variable or exchangeable choking device. A substitute barrel having a different choke can be also attached to the single barrelled shotgun when it is used for another distance shooting.

However, in hunting, there are many cases where the use of a choked barrel shotgun is unavoidable in making a long distance shot by reasons of geography, the habits of game, the performance of the hunting dog, economy etc. In addition, in actual hunting, quick shooting is required and even when a variable choking device is available, the hunter does not oftentimes have sufficient time to adjust it, to say nothing of the time to replace the choked barrel with a substitute barrel—such replacement in time is almost impossible. Further, in the case of a double barrelled shotgun having a combination of barrels of different chokes, the barrel with a higher degree of choke is not suitable for short distance shooting and repeating two shots at a short distance is not desirable. Moreover, when a gamebird is shot with a single-barrelled repeater gun while the game is moving away, it is considered usual that the first shot is at a short distance, the second is at a medium distance and the third is at a long distance but it has so far not been possible to repeat such shootings by use of chokes corresponding to the respective distances.

The object of the present invention is to eliminate the drawbacks mentioned above.

When a scatter load (cartridge) according to the present invention is shot from a full choked barrel, the load displays a wide pellet spreading range equal to or superior to that obtained by a standard load shot from an improved cylinder barrel and also displays a uniform and desirable pattern, and, accordingly, even a highly choked barrel shotgun could be used for performing ideal middle and short distance shootings by the selection of such a load. This applies to skeet shooting using a highly choked hunting gun.

The present invention has been developed to satisfy the above-mentioned ideal shooting and a preferred embodiment of the present invention will now be explained with reference to the accompanying drawings, in which.

Figure 1:
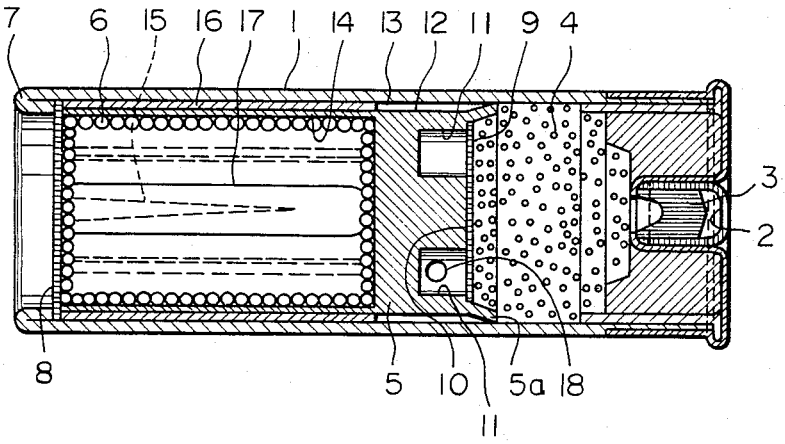
FIG. 1 is a sectional view of a cartridge according to the present invention.

In FIG. 1, Numeral 1 indicates a case including a brass case head, Numeral 2 a primer, Numeral 3 an anvil Numeral 4 gunpowder, Numeral 5 a wad (kollos in Dutch), and Numeral 6 a group of pellets, respectively.

Figure 5:
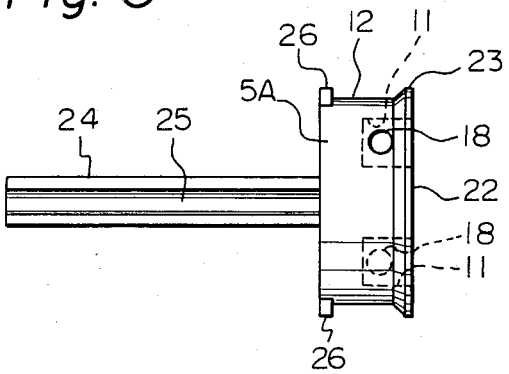
FIG. 5 is a side view of another embodiment of a wad of the cartridge according to the present invention.
Figure 6:
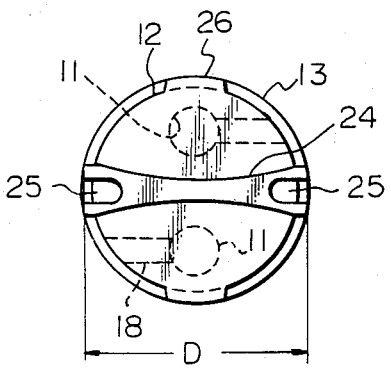
FIG. 6 is a front view of FIG. 5.

The wad 5 shown in FIGS. 1–4 is formed of a cylindrical body 5*b* of polyethylene or like material and has a conical end projection 5a having a concave portion 10 on its end facing the gunpowder 4. The annular projection 5a acts as a seal which is in contact with the inner surface of the case 1 to prevent leakage of gases when the wad is located within the case 1 and which comes into contact with the inner surface 20 of the barrel 21 (FIG. 4) during the passage of the wad through the barrel. Alternatively, as shown in FIGS. 5 and 6, the conical end projection 5a (FIGS. 1–4) can be replaced by a conical end projection 23 which has a flat end surface 22.

Figure 3:
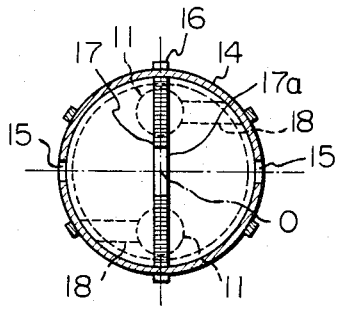
FIG. 3 is a front view of FIG. 2.
Figure 4:
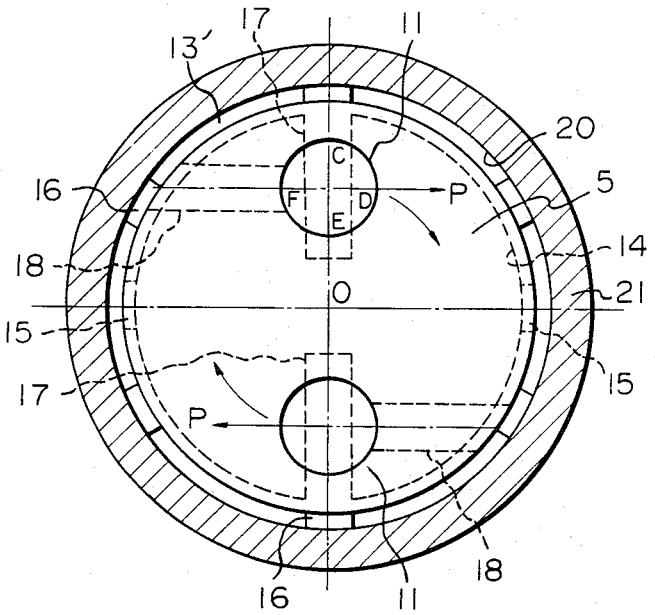
FIG. 4 is a sectional view of the wad taken along IV—IV line of FIG. 2.
Figure 7:
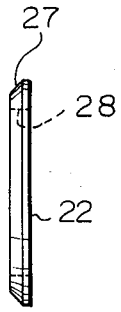
FIG. 7 is a side view of ring as a gas sealing member.
Figure 8:
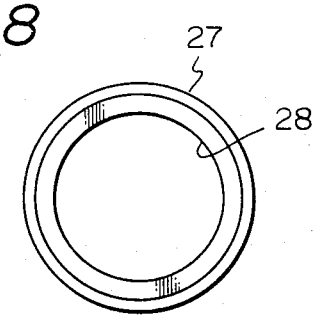
FIG. 8 is a front view of FIG. 7.
Figure 9:
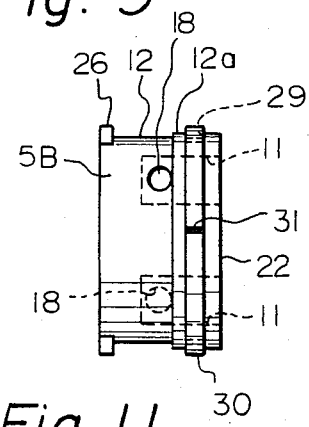
FIG. 9 is a side view of an essential portion of another embodiment of the gas sealing member.
Figure 10:
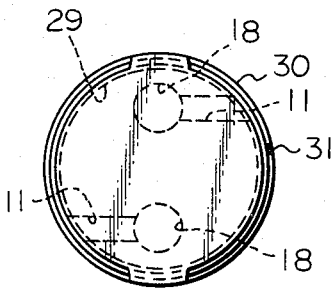
FIG. 10 is a front view of FIG. 9.

The diameter of the enlarged end of the projection 5a or 23 is substantially equal to the diameter of the barrel bore defined by the inner surface 20 (FIG. 4). Furthermore, it is also possible to produce a separate piece of seal member which can be attached to the wad body, as shown in FIGS. 7 and 8. In FIGS. 7 and 8, a conical ring 27 as a seal member corresponding to the projection 5a or 23 has a hole 28 in which the wad 5 (FIGS. 1–4) or 5A (FIGS. 5 and 6) is fitted. For this purpose, the wad is provided, on its end facing the powder 4, with a circular projection (not shown) which has a diameter substantially corresponding to the inner diameter of the hole 28 of the ring 27 and which has a height substantially corresponding to the thickness of the ring 27. In this embodiment illustrated in FIGS. 7 and 8, the seal ring 27 also serves as a slide bearing of the wad. Alternatively, it is also possible to provide a wad 5B which has at its outer periphery 12a a peripheral groove 29 in which a resilient ring 30 with a ringe gap 31 like a piston ring is fitted, as shown in FIGS. 9 and 10. It should be noted here that the seal mechanism is not limited to the illustrated embodiments and may be of any construction which can ensure a seal effect against the explosion pressure of the gunpowder and which can decrease the friction which resists the rotational movement of the wad passing through the barrel.

A plurality of blind holes 11 are provided on the end of the wad that faces the gunpowder when the wad is located in the case 1 (FIG. 1). The blind holes 11 are equiangularly located on a circle around the center 0 (FIGS. 3, 4) of the wad.

In the illustrated embodiments (FIGS. 1–4), two blind holes 11 are diametrically arranged. The wad 5 (or 5A, 5B, 5C or 5D) rotates in a clockwise direction when viewed from the powder 4. A disc cover 9 (FIG. 1) is attached to the concave portion 10 (FIG. 1) or the end surface 22 (FIGS. 5, 9, 11, 13) to cover the blind holes 11. The disc cover 9 prevents the powder 4 from coming into the blind holes 11. The cover 9 can be easily broken under the explosive pressure. The cover 9 can be dispensed with when the powder 4 which is compacted by the pressure at the loading of the powder is such that it does not get out of shape even without the cover. Each blind hole 11 has a restriction passage 18 connected thereto for applying a torque due to the thrust of the explosion to the wad 5. The explosion gas is partly ejected from the restriction passages 18 for providing the thrust P in the direction perpendicular to a line connecting the centers of the blind holes and the center 0 of the wad, as shown in FIG. 4. For this purpose, one end of each restriction passage 18 is connected to the corresponding blind hole 11 in the vicinity of the bottom of the blind hole and the other end of each restriction passage 18 which extends in a direction opposite to the direction of the thrust P is connected to the peripheral side wall 12 of the wad body and opens into the outside thereof.

The diameter of the cylindrical periphery 12 of the wad is smaller than that of the sealing member such as the annular projection 5a (FIG. 2) or 23 (FIGS. 5, 13), or the ring 27 (FIG. 7) or 30 (FIG. 9), so that when the wad is in case 1, a gas discharging gap 13 is provided between the inner periphery of case 1 and the outer periphery 12 as shown in FIG. 1, and when the wad 5 passes through the barrel 21 (FIG. 4), a gap 13' is also provided between the inner periphery 20 of the barrel which has a diameter substantially equal to that of the inner periphery of the case 1 and the outer periphery 12. These gaps 13 and 13' define a passage for the exhaust gas after the explosion of the powder 4 has occurred. These gaps can be replaced by an axial groove or grooves (not shown) formed on the outer periphery 12 of the wad.

On the side of the wad 5 (FIGS. 1, 2), that faces the pellets (shot) 6 when the powder 4, the wad 5 and the pellets 6 are located in the case 1, is provided a container 14 of hollow cylinder which is integral with the wad body 5b and which has an axial length long enough to reach the paper disc cover 8 or it may be shorter than that.

Figure 2:
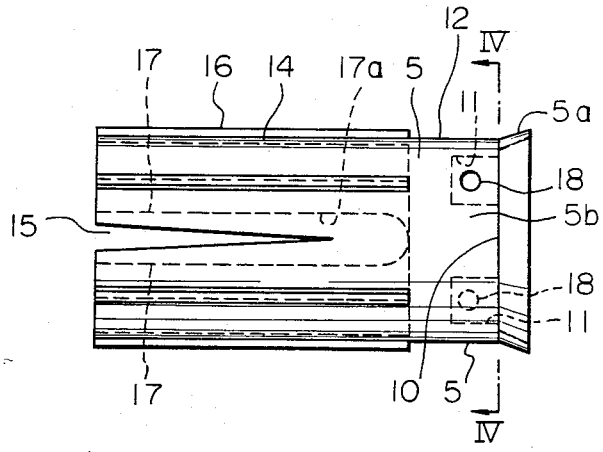
FIG. 2 is a side view of a wad of the cartridge according to the present invention.

Further, on the outer circumferential surface of the container 14 there are provided a plurality of projections or protrusions 16 extending in the direction of axis thereof in symmetrical relationships with one another. The protrusions 16 define, between the container 14 and the inner periphery of the case 1, an exhaust gas passage (not shown) which is connected to the gap 13. The container 14 has a pair of V-shaped notches 15 (FIGS. 1 and 2). The inner wall surface of the container 14 is provided with a pair of partitions 17 in the diametral direction intersecting at right angles with the notches 15 at circumferential positions midway between the notches. The partitions 17 define an axial slit 17a therebetween. These partitions 17 serve as means for transmitting a rotary motion to the pellets 6.

The number and the shapes of the notches 15, slit 17a, the partitions 17 and the protrusions 16 can be modified so that they can fully perform their functions. It is also possible to manufacture the partitions 17 separately from the container 14 and then the partitions 17 are attached to the container 14 so as to transmit the rotation of the wad 5 to the pellets 6.

A predetermined quantity of pellets 6 is packed into the container 14 and are blocked with the paper disc cover 8 fitted to the opening end of the container 14 which is locked by a crimp 7, or stopped by a so called starcrimp formed by folding the top end of the case inwardly. The wad 5 which contains the pellets 6 is located and fixed in the case 1 to form a cartridge.

Three embodiments illustrated in FIGS. 5, 6; 11, 12; and 13, 14 do not include a member corresponding to the container 14. Instead of a container, a blade or a plurality of blades serving as means for transmitting a rotary motion to the pellets 6 is provided on the side of the wad that faces the pellets 6, in these embodiments. The pellets 6 are packed around the blade(s). In the embodiment in FIGS. 5 and 6, it includes a single blade 24 which has an axial length reaching the paper disc cover 8 of FIG. 1 or shorter than that when the gunpowder 4 and the wad 5A are located in the case 1. Both ends of the blade 24 are provided with thick walled portions in which grooves 25 are formed in the direction of the axis thereof to provide a passage for the exhaust gas. The grooves 25 are connected to the gap 13.

In this embodiment in FIGS. 5 and 6, there are provided a desired number of protrusions 26 on the circumferential surface 12 of the wad 5A such that the diameter of a circle passing through the vertex of each of the protrusions 26 is substantially the same as the inner diameter of the case 1 and the inner wall surface 20 of the barrel 21 (FIG. 4). These protrusions 26 perform the same functions as those of the protrusions 16 formed on the outer circumferential surface of the container 14. Preferably, the blade 24 has a diameter D which is substantially identical to the inner diameter of the case 1 and the inner diameter of the barrel, so that the blade 24 can perform a role of protrusions the same as that of the protrusions 26.

The protrusions 26 also contribute to prevent the wad 5A, when it passes through the barrel 21, from being deflected with respect to the axis of the barrel. A part of the exhaust gas directly comes into spaces between the pellets 6 through the gap 13 and is discharged into the barrel through the spaces between the pellets 6.

Figure 11:
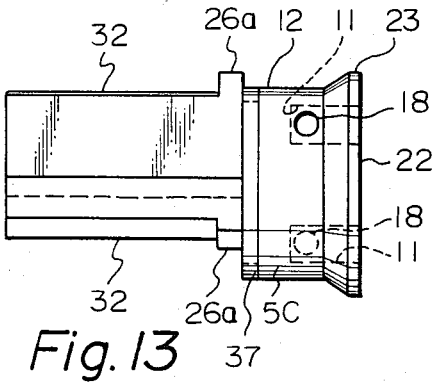
FIG. 11 is a side view of still another embodiment of a wad.
Figure 12:
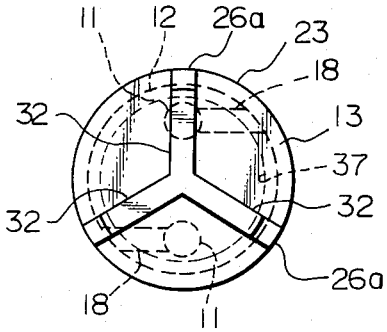
FIG. 12 is a front view of FIG. 11.

In an embodiment shown in FIGS. 11 and 12, on the side of the wad 5C that faces the pellets 6 are provided three blades 32 which are equiangularly arranged and which are provided on their outer ends, with projections 26*a* for performing the same functions as those of the protrusions 16 or 26. Through the gap 13 which is small enough to prevent the pellets 6 from coming therein, the exhaust gas directly enters the spaces between the pellets 6, and, then, it is discharged into the barrel 21 (FIG. 4).

Figure 13:
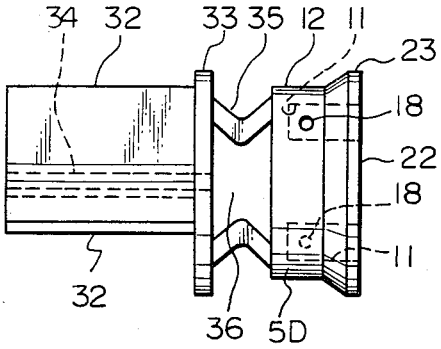
FIG. 13 is a side view of another embodiment of a wad.
Figure 14:
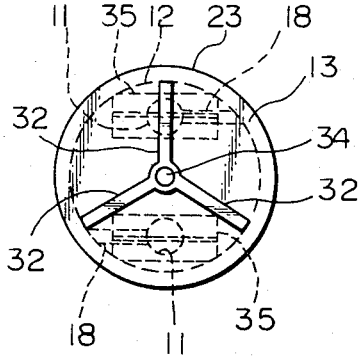
FIG. 14 is a front view of FIG. 13.

In an embodiment shown in FIGS. 13 and 14, there is provided a circular plate 33 which has a diameter substantially equal to that of the bore of the barrel 21 and which is provided with three equiangularly arranged blades 32. A passage 34 for the exhaust gas is formed in the center portion of the blades 32 at which the blades are interconnected. The plate 33 performs the same functions as those of the protrusions 16 (FIG. 3), 26 (FIG. 5) or 26*a* (FIG. 11) and also provides a seal effect for the exhaust gas. The plate 33 is rigidly connected to the wad 5D by means of cushions 35 which can be deformed when they are pushed by the wad 5D which is subjected to the explosive pressure to absorb the explosive pressure of the powder 4 which rapidly increases at the initial stage of explosion. The outer diameter of the cushions 35 is smaller than that of the periphery 12 of the wad 5D. The cushions 5 are for example diametrically opposed to each other so that a space 36 is provided which is always connected to the gap 13 even when the cushions are deformed. The space 36 is also connected to the passage 34 so that the exhaust gas from the gap 13 flows through the space 36 and the passage 34, and is then discharged into the barrel bore. The cushions 35 can be dispensed with and in this case the blades 32 are directly connected to the wad 5D. Further, in this case, an exhaust gas passage (not shown) must be formed in the wad body to connect the outer periphery 12 of the wad 5D and the passage 34. Further, all or some of the wad (body) 5D, the cushions 35, the plate 33, and the blades 32 can be formed as separate elements which can be assembled later.

The cushions 35 can be replaced by a bellows tube which contains therein a compressible fluid (e.g. air).

Figure 15:
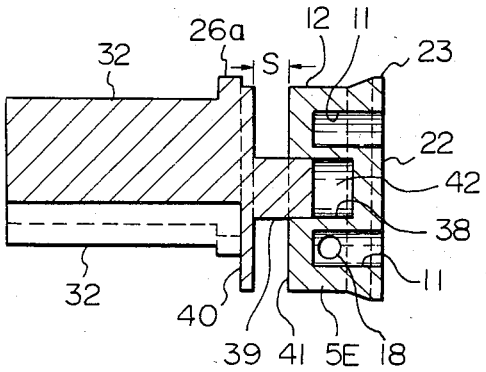
FIG. 15 is a sectional view of a variant of FIG. 13.

FIG. 15 shows a variant of a wad illustrated in FIG. 13.

In FIG. 15 which is a sectional view taken along a plane including the center of the blades 32 and the center axis of the wad 5E, the wad (body) 5E is connected to the blades 32 by means of a plunger 39 which is in turn rigidly connected to a disc plate 5 integral with the blades 32. The wad body is provided, on its end face 41 opposing the disc plate 40, with a blind hole 38 in which the plunger 39 is press fitted, so that the rotation of the wad body can be transmitted to theblades 32 by the friction between the plunger 39 and the inner periphery of the blind hole 38. The blind hole 38 extends generally to the center axis of the wad body. The disc plate has a diameter substantially equal to that of the outer periphery 12 of the wad body 5E. Between the disc plate 40 and the end face 41 of the wad body is provided a predetermined gap S which enables the wad body to move toward the blades 32. When the plunger 39 is press fitted in the blind hole 38 a closed space 42 is provided in the blind hole 38 by the plunger 39. When the explosion of the gunpowder takes place, the wad body first moves toward the blades 32 while compressing the air in the closed space 42 until the wad body comes in contact with the disc plate 40. The blades 32 on which the pellets 6 (FIG. 1) are packed do not move forward until the wad body comes into collision with the disc plate 40, since the blades 32 bear against the paper disc cover 8 which is held by the crimp 7 (FIG. 1). After the wad body collides with the disc plate 40, the wad body and the blades are ejected from the case 1 while maintaining their relative angular position, in the same fashion as in FIGS. 11 and 12. As can be seen from the above discussion, the combination of the plunger 39 and the blind hole 38 in which the plunger 39 is press fitted provides a cusion mechanism the same as the cushions 35 in FIGS. 13 and 14. It should be noted here that, instead of the press fit of the plunger 39 into the blind hole 38, a spline mechanism of a serrated mechanism can be provided between the plunger 39 and the blind hole 38 so that the wad body can move axially on the plunger 39 but cannot rotate relative to the latter. Alternately it is also possible to provide a plunger and a blind hole which have complementary polygonal shapes in section or which have complementary convex and concave shapes.

In the three embodiments mentioned above, which include no container, the pellets 6 are directly located around the blade 24 or blades 23. Apart from this location of the pellets 6, the constructions of the paper disc cover 8 and the crimp 7 are the same as those in the embodiment including the container 14. The shape and the number of the blades are not limited to the above mentioned embodiments. For example, the blades 32 may be of spiral shape.

Furthermore, in the wad 5 shown in FIGS. 2 and 3, the projections 16 and the partitions 17 can be dispensed with. In this case, or the end of the wad that faces the pellets 6 are provided a required number of protrusions 26 as shown in FIGS. 5 and 9 and the notches 15 extend to the bottom of the container 14. Also in this case, the blades 32 can be provided in the container 14. In this modification, the exhaust gas passes through the gap 13 and the space between the protrusions 26. Then, a part of the exhaust gas passes through the small gap between the container 14 and the barrel bore and the remaining exhaust gas enters the pellets 6 through the notches 15 and can be discharged into the barrel bore similar to the embodiment shown in FIGS. 11 and 12.

When small size pellets 6 are used, they may break the front edge of the periphery 12 so that they enter the gap 13. In order to solve this problem, a ring 37 which is made of material, such as steel, harder than the pellets 6, can be provided on the front end of the periphery 12, as shown in FIGS. 11 and 12. The ring 37 can prevent the pellets 6 from coming into the gap 13.

It is also possible to provide a container 14 which includes neither the protrusions 16 nor the partitions 17 and which has a diameter substantially equal to that of the barrel bore. In this case, the blades 32 having the passage 34 (FIGS. 13 and 14) connected to the gap 13 can be provided in the container 14. The exhaust gas can be discharged from the passage 34.

Furthermore, it should be noted that various kinds of modifications or variants mentioned above can be optionally combined.

The operation of the cartridge of the present invention having the above structure will now be explained. When a firing pin (not shown) strikes the primer 2 having the anvil 3, the gunpowder 4 is ignited to generate an explosive gas and when the pressure of the gas reaches a value of about 70 lbs/in$^2$ the disc cover 9 is broken. The wad 5 begins to move forward and at the same time the top end of the container 14 which is integral with the wad 5 and which stores the pellets 6 therein pushes out the paper disc cover 8 to release the crimp 7 of the case 1. Thus, a portion of the explosion gas pressure enters the blind holes 11 and then reaches the rear surface of the cover 8 from the gap 13 via the passage 18. However, since the cover 8 has already been scattered into the barrel bore at this time, the explosive gas jetted out from the blind holes 11 is discharged out into the atmosphere, together with the cover 8.

When the explosion gas pressure is released, a torque generates on the wad 5 due to the princple of jet propulsion and, in the case of the embodiment of FIGS. 1 to 3, the wad 5 including the container 14 integral therewith begins to rotate and pass through the internal wall surface 20 of the barrel 21 during which the speed of rotation of the wad increases rapidly. The factors for generating the torque on the wad by discharging a part of the explosion gas pressure may be explained as follows: When, in FIG. 4, the pressure receiving area of the side portion of the inner wall of each of the blind holes 11 as indicated by letters CDE is compared to that indicated by letters EFC, it will be seen that the former is larger than the latter by the effective sectional area of each of the restriction passages 18 because each restriction passage opens toward that EFC side and because it comes into contact with the atmosphere through the gaps formed by the protrusions 16 on the outer circumferential surface of the container 14 when the wad 5 passes through the internal wall surface of the barrel. Accordingly, a pressure difference takes place between the pressure receiving areas of both of the above-mentioned sides due to the difference in width between their pressure receiving areas and a force P acting in the direction of an arrows in FIG. 4 generates whereby a torque about the central point 0 of the wad is obtained.

Thus, the passage of the rotating wad 5 through the internal wall surface 20 of the barrel causes the rotation of the container 14 integral with the wad 5. Accordingly, the pellets 6 stored in the container 14 make circular motions about the center axis of the container 14 together with the rotation of the wad 5 in the state of their being separately put into two sections by the partitions 17. When the wad 5 goes out from the muzzle, the container 14 is split into two parts through the notches 15 and the flying speed of the wad decreases rapidly due to the wind pressure exerted on its area wider than before. Therefore, the group of pellets stored in the container fly forward leaving the wad 5 behind and, in this case, each of the pellets 6 flies at a combined speed of the tangential speed of its circular motion just prior to its leaving away from the container 14 and its speed in the direction of the shot traveling. Thus, the pellets can be positively spread even when they are shot from a choked barrel.

Further, it should be noted that the individual pellets fly in directions slightly different from one another because of the fact that the tangential speed of the pellets located outside is different from that of those located inside and, therefore, the pellets as a group spread uniformly without forming a doughnut-like pattern. Further, assuming that two kind of shots have the same muzzle velocities and the same continuing velocities which the shots maintain at the time when the shots have travelled through a certain distance, the rate of spreading of the pellets or shot being determined by the speed of rotation of the wad leaving the muzzle so that the required rate of spreading can be obtained by the proper selection of the diameter of each of the restriction passages 18, the burning characteristic and the quantity of the loaded gunpowder 4 to thereby adjust the resultant torque on the wad. The above discussion is applicable to the embodiments which do not have the container 14.

In addition, in the case of using the blade 24 shown in FIGS. 5 and 6, rotating power is transmitted to the pellets 6 through the blade 24 so that the pellets reach the muzzle after passing through the barrel while keeping their mass state since the pellets 6 are forced by the wad 5A which continues the rapid acceleration motion by the explosion after having left the case 1. In this case, since each pellet rotates about the axis of the barrel, the pellets fly while radially spreading after having left the muzzle, like the pellets which are shot from the wad having the container 14, as mentioned above.

Although the embodiment illustrated in FIGS. 11 and 12 is different from the embodiment shown in FIGS. 5 and 6 in that three blades 32 are provided and the passage for the exhaust gas is defined by the spaces between the pellets 6 in FIGS. 11 and 12, the pellets are forced to be spread out by their rotational movement, similarly to the embodiment in FIGS. 4 and 5. It has been experimentally found that no pellet is melted by the exhaust gas nor stuck to each other. This is because the high temperature exhaust gas is expanded after ejection, resulting in a decrease of the temperature and because the pellets 6 are in contact with the exhaust gas for an extremely short period of time.

The embodiment shown in FIGS. 13 and 14 operates substantially the same as the embodiment shown in FIGS. 11 and 12 except for the route of the exhaust gas and for the presence of the cushions 35.

In the three embodiments which include no container, since the wad which is formed by a material having a density below 1 is light and since the area which is subject to the wind pressure is large, the ejected wad rapidly decelerates and is separated from the pellets 6 so that the wad has no undesirable influence on the pattern.

As described above, the scatter load type of cartridge according to the present invention is constructed so that a group of pellets are packed into a container which is formed integral with a wad and which has partitions formed therein, the wad is caused to pass through a barrel by a gas pressure generation due to the explosion of gunpowder during which a torque is generated by the action of jet propulsion to cause the group of pellets to take circular motions, whereby when the container goes out from the muzzle of the barrel, it is split into two parts, or in the case of a wad having no such container, the group of pellets are forced to fly separately from the wad as the flying speed of the latter is reduced. Thus the cartridge according to the present invention has an advantage in that it can be used with the long distance choked barrel shotgun even in making a short distance shot with a wide pellet spreading range equal to that obtained in the case of a short distance shotgun and with a uniformly distributed desirable pattern and ideal short and medium distance shooting can be performed with a long distance choked barrel shotgun by the selection of such cartridge.

Finally, the wad according to the present invention can be adapted to reload a shotgun cartridge.

I claim:

1. A wad for use in a cartridge for a shotgun, said cartridge including a case having an outer wall, said wad being located in said case between gunpowder and a charge of pellets, said wad comprising:

a solid cylindrical body having an end face adjacent to the gunpowder and a side surface extending away therefrom;

a plurality of independent, non-axial, symmetrically located blind holes in the end face of said body;

a plurality of independent and separate restriction passages of number equal to the number of blind holes, each of said restriction passages connecting with a different blind hole, said restriction passages being non-radial and extending to the side surface of said body in directions which cause torques due to explosive gas flowing therethrough to be additive;

means attached to the side surface near the bottom of said body, for preventing escape of explosive gas along the side surface;

means for transmitting rotation of said body to said pellets;

means, for attaching said rotation transmitting means to said body; and means, spaced from said gas escape preventing means and attached to one of said body and said rotation transmitting means, for contacting the wall of said case so as to stabilize said wad as it is propelled from said case;

whereby said blind holes are non-axial so as to be sufficiently spaced from the axis of said body to create in combination with said restriction passages a sufficient torque for rotating said body without creating a large, pressure reducing central chamber.

2. A wad in accordance with claim 1 wherein said attaching means includes a disc plate between said body and said rotation transmitting means, said body having a top surface at an end opposite from the bottom, said attaching means further including an axially aligned cavity in the top surface of said body, said attaching means also including an axially aligned plunger attached to said disc and extending into the cavity of said body, whereby said cavity extends into said body between and from an end opposite from said blind holes so as to receive said plunger and with said disc plate cushion the accelerational impact of said body against said disc plate and said charge as the explosive gas expands.

3. A wad according to claim 1 including means for providing a peripheral gap which defines a gas discharging passage between the cylindrical body and the case for gas cooling and exhausting, said restriction passages being connected to the peripheral gap.

4. A wad according to claim 3, wherein said gap providing means includes a sealing member as an outer peripheral projection which is integral with and provided on the cylindrical body.

5. A wad according to claim 3, wherein said sealing member comprises a separate ring which can be fitted on one end of the cylindrical body.

6. A wad in according to claim 1 including a container which is connected to the cylindrical body and which stores therein the charge comprised of a mass of pellets.

7. A wad according to claim 6, wherein said container comprises a plurality of axially extending outer peripheral protrusions which provide an exhaust gas discharging space between the case and the container, said space connected to said explosive gas passages.

8. A wad according to claim 6 wherein said rotation transmitting means includes partitions within said container to transmit a rotational movement of the wad to the pellets stored in the container.

9. A wad according to claim 6 wherein said container includes notches which can be easily split.

10. A wad according to claim 1 wherein said rotation transmitting means includes at least one blade which is connected to the cylindrical body and which contacts the charge comprising a mass of pellets so as to transmit a rotational motion of the wad to the pellets.

11. A wad according to claim 10, wherein said rotation transmitting means includes a plurality of equiangularly arranged blades.

12. A wad according to claim 10, wherein said contacting means includes at least one peripheral protrusion attached to said blade and in contact with the inner periphery of the case of the cartridge.

13. A wad according to claim 10, wherein said blade includes grooves for the exhaust gas which are connected to the peripheral gap and which are provided on the opposed ends of the blade.

14. A wad according to claim 11, wherein said rotation transmitting means includes peripheral protrusions on said blades, outermost peripheries of which are located in the same circle so as to come in contact with the inner periphery of the case.

15. A wad according to claim 11, wherein said blades are connected to each other at their base which is provided with a center exhaust gas passage which is connected to the peripheral gap.

16. A wad according to claim 1 including a disc plate and wherein said rotation transmitting means includes at least one blade connected to said disc plate to carry said charge comprising a mass of pellets and to transmit a rotational motion of the wad to the pellets, said disc plate being connected to the cylindrical body by means of at least one deformable member.

17. A wad according to claim 1 including a disc plate and wherein said rotation transmitting means includes at least one blade connected to said disc plate to carry said charge comprising a mass of pellets and to transmit a rotational motion of the wad to the pellets, said disc plate being connected to the cylindrical body by means of a fluid compressible member.

18. A wad according to claim 1 including a disc plate and wherein said rotation transmitting means includes at least one blade connected to said disc plate to carry said charge comprising a mass of pellets and to transmit a rotational motion of the wad to the pellets, said disc plate being provided with a plunger connected thereto, said cylindrical body being provided with a cavity in which said plunger is movably fitted in the travelling direction of the wad so as to form a cushion space in the cavity.

19. A wad according to claim 1 wherein said blind holes are equiangularly spaced from one another and located on a circle about the center of the wad.

* * * * *

UNITED STATES PATENT AND TRADEMARK OFFICE

CERTIFICATE OF CORRECTION

PATENT NO. : 4,506,605

DATED : March 26, 1985

INVENTOR(S) : Nagatoshi Maki

It is certified that error appears in the above-identified patent and that said Letters Patent is hereby corrected as shown below:

Column 5, line 47, delete "5" and insert --35--.

Column 6, line 2, delete "5" and insert --40--.

Column 6, line 6, delete "theblades" and insert --the blades--.

Column 6, line 8, delete "generally" and insert --coaxially--.

Column 6, line 31, delete "cusion" and insert --cushion--.

Column 6, line 44, delete "23" and insert --32--.

Column 7, line 33, delete "princple" and insert --principle--.

Signed and Sealed this

*Third* Day of *September 1985*

[SEAL]

*Attest:*

DONALD J. QUIGG

*Attesting Officer* *Acting Commissioner of Patents and Trademarks - Designate*